United States Patent [19]

Iwata et al.

[11] Patent Number: 4,807,294

[45] Date of Patent: Feb. 21, 1989

[54] PIEZOELECTRIC AND FOAM RESIN SHEET SPEAKER

[75] Inventors: Yoichi Iwata; Nubuo Tanaka; Junichi Katurayama, all of Yokkaichi, Japan

[73] Assignee: Mitubishi Petrochemical Co., Ltd., Japan

[21] Appl. No.: 63,548

[22] Filed: Jun. 17, 1987

[30] Foreign Application Priority Data

Jun. 20, 1986 [JP] Japan ..... 61-095257[U]
Apr. 10, 1987 [JP] Japan ..... 62-088215

[51] Int. Cl.[4] ..... H04R 17/00

[52] U.S. Cl. ..... 381/190; 381/158; 381/86; 381/188; 381/182; 310/322

[58] Field of Search ..... 381/152, 153, 158, 173, 381/182, 205, 86, 190, 203; 310/322, 324

[56] References Cited

U.S. PATENT DOCUMENTS 1,864,615 6/1932 Quinby ..... 381/152
3,573,394 4/1971 Birnbaum ..... 381/173 X
3,621,155 11/1971 Pruitt ..... 381/205 X
3,861,495 1/1975 Pearson ..... 181/157 X
4,079,213 3/1978 Bage et al. ..... 381/190 X
4,198,550 4/1980 Matsuda et al. ..... 381/203 X
4,240,002 12/1980 Tosi et al. ..... 381/205 X
4,295,009 10/1981 Weidler ..... 310/324 X

FOREIGN PATENT DOCUMENTS 91099 6/1982 Japan ..... 381/190

*Primary Examiner*—Eugene R. LaRoche
*Assistant Examiner*—Benny Lee
*Attorney, Agent, or Firm*—Donald D. Mon; David O'Reilly

[57] ABSTRACT

A sheet speaker comprised of a planar piezoelectric ceramic sheet encapsulated in a planar sheet of hard resin foam, comprised of a polystyrene, urethane, urea or phenolic. The planar piezoelectric ceramic sheet is centered in the planar hard resin from sheet which provides a surface area of 10–50 times the surface area of the planar piezoelectric sheet. The surface of the planar hard resin foam may be lined with cloth, paper, or plastic film.

10 Claims, 4 Drawing Sheets

PIEZOELECTRIC AND FOAM RESIN SHEET SPEAKER

FIELD OF THE INVENTION

The present invention relates to a sheet speaker, particularly to a thin plane sheet speaker comprising piezoelectric film to reproduce music, sounds, or speech for advertisement, public address, ornament, or similar purposes. It is useful in show rooms, exhibit halls, or display windows, and can be hung on or leaned against a wall or pillar.

BACKGROUND OF THE INVENTION

Piezoelectric speakers are known. As an example, the piezoelectric speaker in FIG. 8 includes substrate 27 which has a film piezoelectric element 22 adhered to an outer curve thereof. The film piezoelectric element 22 comprises two electrode films 25*a* and 25*b* and a high polymer piezoelectric film 24 therebetween. This speaker also has lead wires 26*a* and 26*b* connected to the electrode films 25*a* and 25*b* to an input electric sound signal. The speaker then can output sound from an inner curve of the substrate 27.

However, the above-mentioned conventional piezoelectric speaker is defective in that it cannot be made planar, because an output sound level thereof is decreased too low to be employed in practical use. The speaker, therefore, has to be shaped to a curve. This restricts its uses to places and ways of installation. For example, it is difficult to hang it on or lean it against walls or pillars.

Further, the speaker involves the problem that if ornamented with a design or pattern for use as poster, the design or pattern can be distorted as a curve, affecting the environment.

As another example there has been proposed a ceramic piezoelectric speaker. This art is advantageous in that the piezoelectric ceramic provides a rather high conversion efficiency of electric power to acoustic power in unit area. However, the ceramic piezoelectric device is defective in that it is difficult to fabricate piezoelectric ceramics of large area. This means that the ceramic piezoelectric device itself cannot provide a high acoustic conversion efficiency, resulting in low acoustic power. To produce higher acoustic power, as shown in FIG. 9, the conventional ceramic piezoelectric device 28 is encased in a resonant cavity 29 the placement and installation of the speaker also is restricted, and cannot readily be hung on or leaned against walls or pillars.

BRIEF DESCRIPTION OF THE INVENTION

In view of the prior art described above, including the disadvantages and deficiencies of prior art piezoelectric speakers, it is an object of the present invention to provide a sheet speaker comprising a foam sheet made of hard resin foam and a piezoelectric sheet made of piezoelectric ceramics, wherein the piezoelectric sheet is buried around or at a center of the foam sheet and the foam sheet has a plane perspective area not less than ten times as large as the piezoelectric sheet.

An advantage of the present invention is that a plane speaker is realized with a highly-raised acoustic output power, because the hard resin foam sheet can have the film piezoelectric sheet buried at the center thereof.

Another advantage of the present invention is that the speaker also can serve as a visual notice or information board, and can be suspended on a ceiling or hung on a wall as a shaped plane.

The foregoing objects and advantages and other more specific objects will be evident from the following detailed description and the accompanying drawings, in which:

DETAILED DESCRIPTION OF THE INVENTION

Figure 1:
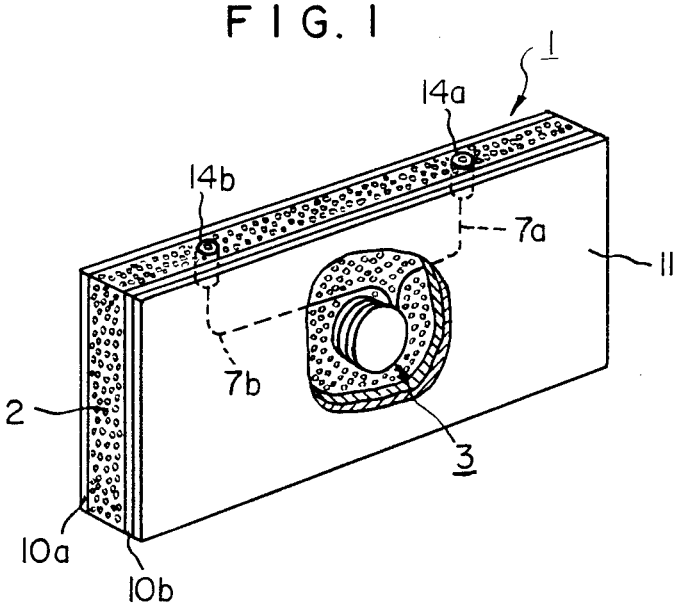
FIG. 1 is a partially cutaway view in perspective of the preferred embodiment of the present invention.

Referring to FIG. 1, a sheet speaker 1 comprises a foam sheet 2 made of hard resin foam and a piezoelectric sheet 3 buried at a center thereof.

Figure 2A:
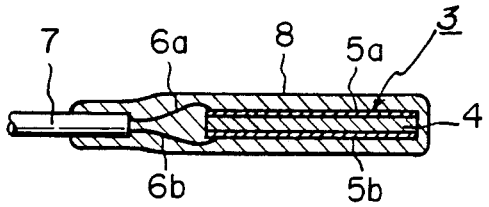
FIG. 2(A) is a horizontal sectional view of the relevant parts of a single-layer embodiment of the present invention.

In FIG. 2(A), the piezoelectric sheet 3 has a piezoelectric ceramic 4 therein and electrode films 5*a* and 5*b* formed on both upper and lower sides thereof.

Ferroelectric substances such as lead titanate-zirconates, lead titanates, and barium titanates can be used for piezoelectric ceramic 4.

Electrode films 5*a* and 5*b* can be formed by metallization of aluminum, gold, or similar metals on the piezoelectric ceramic 4. They can also be formed in an alternative way, for example by conductive rubber or paints coated on piezoelectric ceramic 4. Electrode film 5*a* and 5*b* have lead wires 6*a* and 6*b* connected thereto, which are connected to a cable 7. Cable 7 is led to an audio frequency power amplifier (now shown).

Electrode films 5*a* and 5*b*, lead wires 6*a* and 6*b*, and a part of the cable 7 are covered with insulating material 8 to insulate them. For insulating material 8, rubbers such s silicon rubber or plastics such as epoxy resin can be used. It is preferable to use epoxy resin for the cover so that the foam sheets 2 can be well bonded to the piezoelectric sheet 3.

Figure 2B:
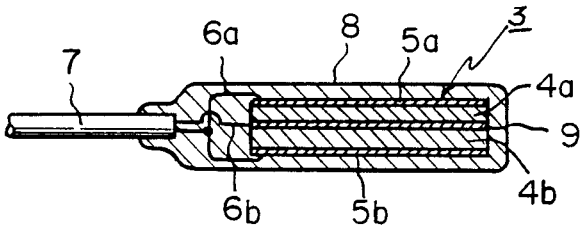
FIG. 2(B) is a horizontal sectional view of the relevant parts of a double-layer embodiment of the present invention.

In FIG. 2(B), double-layer piezoelectric sheet 3 is fabricated in a process so that (1) a shim 9 is made of thin metal sheet of bronze phosphate or similar materials and is provided in the piezoelectric sheet 3, (2) piezoelectric ceramics 4*a* and 4*b* are laid on and under the shim 9 respectively, (3) electrode films 5*a* and 5*b* are formed on the piezoelectric ceramic 4*a* and under 4*b* respectively, (4) lead wires 6a and 6b are connected to the electrode films 5a and 5b and the shim 9 respectively, and (5) these means are covered with insulating material 8, as shown.

The piezoelectric ceramic 4 can be formed to the shape of a disc, polygon, or any other shape, preferably to a circular, or square, or octagonal shape. A preferable diameter or side width of the piezoelectric ceramic 4 is 10 to 80 mm. Thickness of the piezoelectric ceramic 4 is between 0.05 to 3 mm, preferaby 0.1 to 2 mm, and that of the piezoelectric sheet 3 is between 0.2 and 5 mm.

Foam sheet 2 is made of hard resin foam. The hard resin foam used in the present invention should have a tensile elastic modulus greater than $1\times10$ dyne/ $cm^2$, preferably greater than $1.5\times10$ dyne/$cm^2$. The expansion ratio of the hard resin foam is 10 to 80, preferably 10 to 50. For the hard resin foam polystyrene foam, hard urethane foam, urea resin foam, phenolic foam, and similar materials can be used. Thickness of the hard resin foam is between 2 to 100 mm, preferably between 5 to 50 mm.

Foam sheet 2 can be vibrated with vibration of the piezoelectric sheet 3 to produce sounds. Area of the foam sheet 2 is more than 10 times, preferably more than 50 times, even more preferably over 100 times the plane perspective area of the piezoelectric sheet 3.

Foam sheet 2, as shown in FIG. 1, has surface linings 10a and 10b of paper, cloth, or plastic adhered to surfaces thereof, respectively. Foam sheet 2 also can have a style strip 11 adhered to an outside surface of linings 10b as shown if necessary in use of the sheet speaker 1 as will be described in reference to FIG. 5.

To make the style strip 11 waterproof and printable, surface linings 10a and 10b and style strip 11 may be preferably made of a film having microvoids therein under a process wherein (1) talc clay, or similar inorganic powders of 10% to 30% weight is mixed with polyethylene, polypropylene, or similar thermoplastic resin to form film, and (2) the film is pressed so as to produce microvoids therein.

Figure 3A:
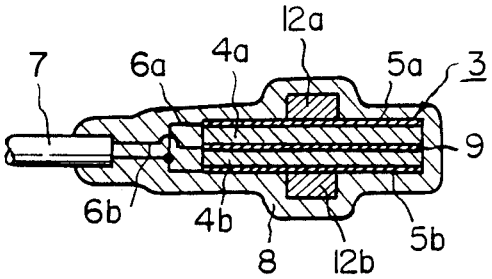
FIG. 3(A) is a horizontal sectional view of the relevant parts of the single-layer embodiment with weights mounted.

In general, the piezoelectric ceramic provides a high sound pressure when it is buried in hard foam substance of large area so that it has a property of high conversion efficiency of voltage to mechanical force. It is, however, defective in that its frequency-response is high at high frequencies. To correct such a problem and to produce a soft tone, weights 12a and 12b may be adhered around or to a center of the piezoelectric sheet 3 as shown in FIG. 3(A).

Figure 3B:
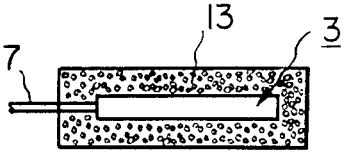
FIG. 3(B) is a horizontal sectional view of a piezoelectric sheet covered with soft foam.

As shown in FIG. 3(B), piezoelectric sheet 3 can be covered with a soft foam means 13 made of soft urethane resin, polyethylene, ethylene-vinyl acetate copolymer, soft vinyl chloride resin, or similar soft resin having a high expansion ratio before the covered piezoelectric sheet 3 is buried in the foam sheet 2 of soft foam substance.

Figure 4:
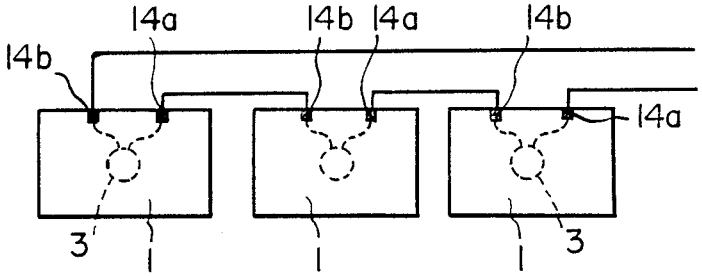
FIG. 4 shows connection of a plurality of the sheet speakers according to the present invention.

In FIG. 4 are shown a plurality of sheet speakers 1 and a plurality of connectors 14a and 14b that connect each of the piezoelectric sheets 3 to the audio signal power amplifier (not shown). It is preferable that as shown in FIG. 1, two connectors 14a, 14b may be provided on each of the sheet speakers 1 with those connected to the piezoelectric sheet 3 through the lead wires 7a and 7b. This allows the plurality of sheet speakers 1 to be connected in series as shown in FIG. 4.

Figure 5:
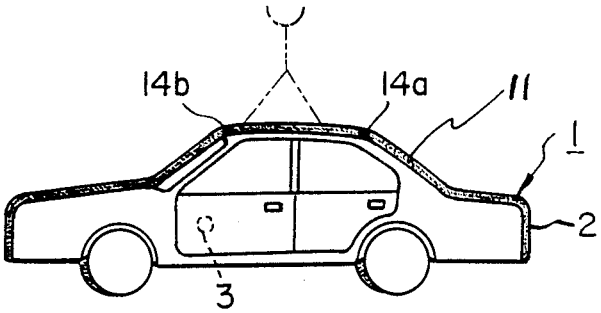
FIG. 5 shows an application of the sheet speaker to an automobile.

FIG. 5 shows an example of use of the sheet speaker 1 wherein the style strip 11 is printed with a desired pattern or the like for purpose of advertisement, public address, or ornamentation. In the figure, the sheet speaker 1 is shaped in conformity with and applied to the outer surfaces of an automobile.

Sheet speaker 1 according to the present invention can be made in an integrated fashion so that piezoelectric sheet 3, cable 7, and connector 14 can be filled in a metallic mold of the foam sheet 2. An example of the process of integrating such means into a unit of, or discrete, sheet speaker 1 will be described in the following paragraphs.

Figure 6:
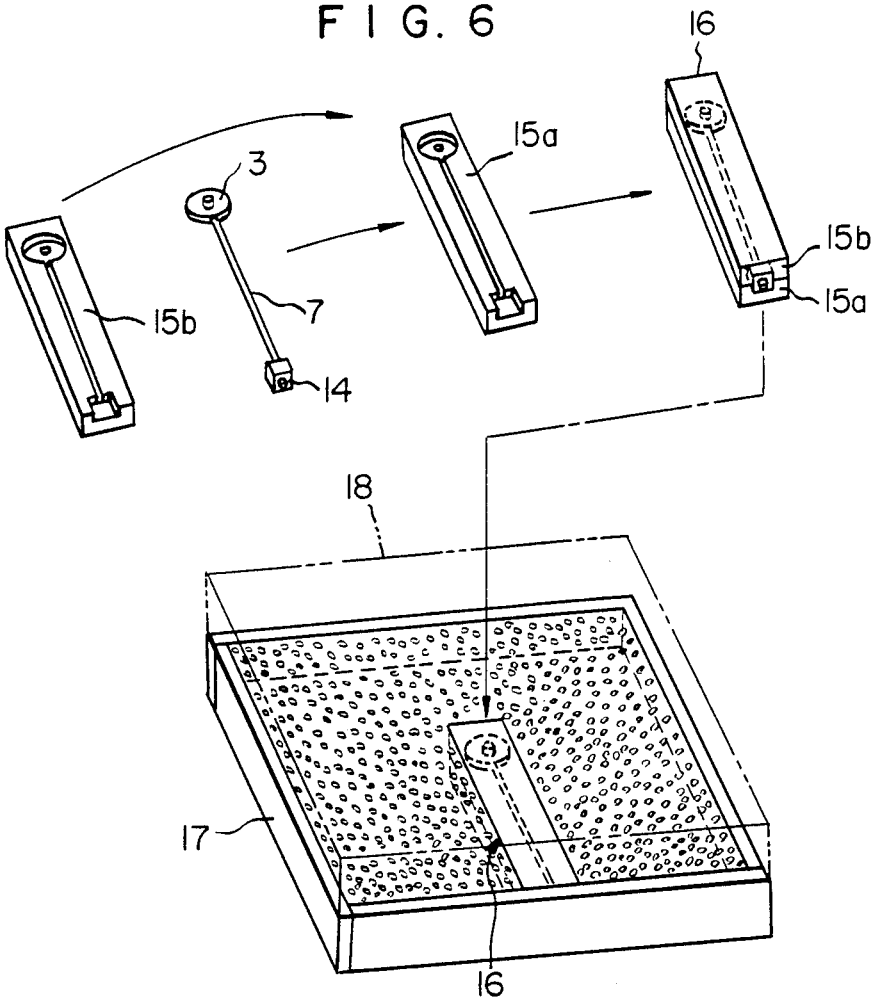
FIG. 6 shows a process for integration of the sheet speaker according to the present invention.

As shown in FIG. 6, a first step of the process of integration is to fabricate a pair of two small-sized molds 15a and 15b as follows. A small sized metallic mold is filled with foaming resin or non-foaming resin by ejection or filled with expandable resin beads and is heated so that the small-sized metallic mold can contain therein a combined unit comprising electrode sheet 1, lead wires 7, and connector 14 connected to each other. After cooling, the small-sized metallic mold is opened to take out the completed small-sized mold 15a; and in the same way, the other small-sized mold 15b is formed.

The resin used in the first step can be polystyrene, polyethylene, polypropylene, ethylene vinyl copolymer, polyvinyl chloride, or similar substances. The foaming resin used can be any of the above-mentioned resins with an added foaming agent.

A second step of the process of integration is to put in and adhere the combined unit to an inside surface of one small-sized mold 15a using a proper bond, and to apply the other small-sized mold 15b thereon as a cover. The combined unit is sandwiched between the pair of small-sized molds 15a and 15b.

Figure 7:
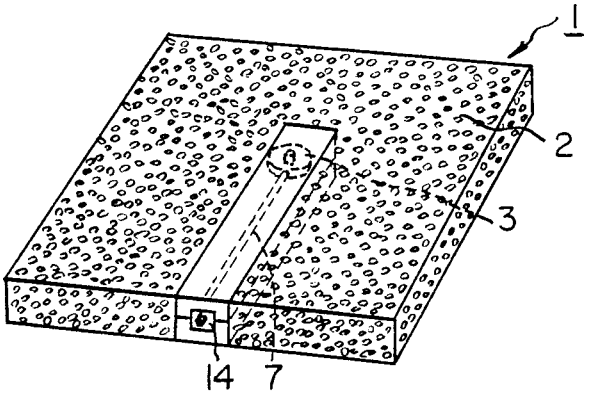
FIG. 7 shows an integrated unit of the sheet speaker according to the present invention.
Figure 8:
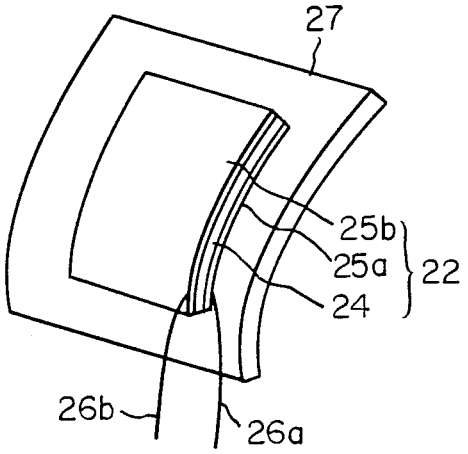
FIG. 8 (PRIOR ART)
FIG. 8 is an illustration showing structure of a conventional piezoelectric speaker.
Figure 9:
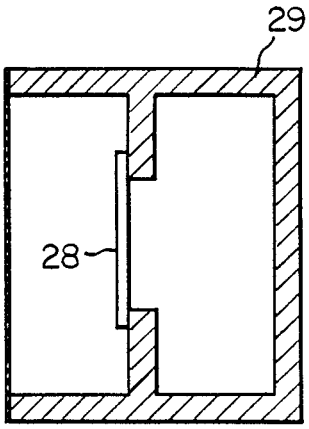
FIG. 9 (PRIOR ART)
FIG. 9 is an illustration showing prior art wherein a resonant cavity contains a piezoelectric device.

A third step of the process of integration is to put in a large-sized metallic cavity mold 17, the sandwich of the small-sized molds 15a and 15b as a core 16 with connector 14 fitted to an inside of large-sized metallic cavity mold 17, to cover a sheet-like metallic mold 18 thereon, fasten the sheet metallic mold 18 to the large-sized metallic cavity mold 17, to fill the space between the fastened molds 17 and 18 with foaming resin or pre-expanded hard foaming resin beads, to heat the fastened-together molds 17 and 18 with steam or in a furnace to melt the foaming resin or pre-expanded hard resin beads to adhere the core 16 thereto, and to remove the both molds 17 and 18. This completes the fabrication of the integrated sheet speaker 1 as shown in FIG. 7.

Now, an audio signal can be input across the electrode films 5a and 5b of the piezoelectric sheet 3 through the lead wires 6a and 6b and the connector 14. Foam sheet 2 then can produce the sound from the surface thereof so that both sides of foam sheet 2 to piezoelectric sheet 3 can resonate the vibration thereof. In the resonant state, the output sound power can be increased so that the whole foam sheet 2 can resound.

There can be provided two or more connectors 14 at different positions of the sheet speaker 1. This feature can be useful in case it is required to cut out a portion of the sheet speaker 1 for replacement with an advertisement medium. Even if some connectors 14 become useless due to cut-off of lead wires 7 connected thereto, the remaining alternative connectors 14 are live and available. With this feature, the sheet speaker 1 can be cut out rather freely.

To obtain a stereophonic sound, two independent sheet speakers 1 can be arranged in adequately spaced-apart places. As an alternative way, a stereophonic sheet speaker set can be implemented in a manner that two units of piezoelectric sheet 3 can be provided in spaced-apart regions of single foam sheet 2.

It will be apparent that the present invention, as described above achieves a simple, light-weight, compact, and economical, thin, planar sheet speaker 1 for reliably producing audio sounds. The increased output sound power can be obtained so that the output sound level can be increased, as piezoelectric sheet 3 is implemented within foam sheet 2 of hard resin. It is suitable to suspend the sheet speaker 1 on a ceiling, hang it on a wall, or lean it against a wall, because the sheet speaker can be easily installed without restrictions of place and method. The style strip 3 on the surface of the sheet speaker 1 is particularly suitable for use as advertisement or public address medium or ornament as the pattern, design, or the like and cannot be distorted thus preserving the amenities.

The present invention thereby contemplates a sheet speaker having a high sound pressure wherein a piezoelectric sheet is buried in a foam sheet. The sheet speaker can be used as advertisement or public address media or as ornament, and can be hung on or leaned against a wall.

This invention is not to be limited to the embodiments shown in the drawings and described in the description, which are given by way of example and not of limitation, but only in accordance with the scope of the appended claims.

What is claimed is:

1. A sheet speaker assembly comprising; a planar piezoelectric ceramic sheet; a planar hard resin foam sheet surrounding and encapsulating said planar piezoelectric ceramic sheet; said planar piezoelectric sheet being approximately at the center of said planar hard resin foam sheet; said planar hard resin foam sheet having a surface area approximately at least ten times the surface area of said planar piezoelectric ceramic sheet whereby said assembly provides a sheet speaker having high acoustic output power.

2. The assembly according to claim 1 in which said planar hard resin sheet is formed of a resin foam selected from the group consisting of polystyrene foam, urethane resin foam, urea resin foam and phenolic resin foam.

3. The assembly according to claim 2 in which said resin foam for forming said planar hard resin sheet has an expansion ratio of approximately 10 to 80.

4. The assembly according to claim 3 in which said expansion ratio is approximately 10 to 50.

5. The assembly according to claim 1 in which the planar surfaces of said planar hard resin foam sheet are covered with a lining of cloth, paper, or plastic film.

6. The assembly according to claim 1 in which the surface area of said planar hard foam resin sheet is approximately at least fifty times the surface area of said planar piezoelectric ceramic sheet.

7. The assembly according to claim 6 in which said planar hard resin foam sheet has a thickness which is approximately in the range of 2 mm to 100 mm.

8. The assembly according to claim 16 in which said hard resin foam sheet has a thickness which is in the range of 5 mm to 50 mm.

9. The assembly according to claim 6 in which said planar hard resin foam has a tensile elastic modulus approximately greater than $1\times10$ dyne/cen$^2$.

10. The assembly according to claim 9 in which said tensile elastic modulus is greater that $1.5\times10$ dyne/cm$^2$.

* * * * *